US006133903A

United States Patent [19]

Lee et al.

[11] Patent Number: 6,133,903

[45] Date of Patent: Oct. 17, 2000

[54] METHOD FOR DRIVING AC-TYPE PLASMA DISPLAY PANEL (PDP)

[75] Inventors: Eun-Cheol Lee; Jae-Hyuck Lee; Bong-Koo Kang; Young-Hwan Kim, all of Kyongaangbuk-do, Rep. of Korea

[73] Assignee: LG Electronics Inc., Seoul, Rep. of Korea

[21] Appl. No.: 08/941,072

[22] Filed: Sep. 30, 1997

[30] Foreign Application Priority Data

Oct. 1, 1996 [KR] Rep. of Korea ..... 96-43464

[51] Int. Cl.[7] ..... G09G 3/22

[52] U.S. Cl. ..... 345/148; 345/76; 345/77; 345/84; 345/55

[58] Field of Search ..... 345/148, 76, 77, 345/84, 55, 60

[56] References Cited

U.S. PATENT DOCUMENTS 4,559,535 12/1985 Watkins et al. ..... 340/793
4,709,995 12/1987 Kuribayashi et al. ..... 345/89
5,317,334 5/1994 Sano ..... 345/148
5,757,348 5/1998 Handschy et al. ..... 345/89
5,767,828 6/1998 McKnight ..... 345/89
5,818,419 10/1998 Tajima et al. ..... 345/147
5,874,932 2/1999 Nagaoka et al. ..... 345/60
5,889,501 3/1999 Sasaki et al. ..... 345/60

*Primary Examiner*—William A. Cuchlinski, Jr.
*Assistant Examiner*—Marthe Y. Marc-Coleman
*Attorney, Agent, or Firm*—Finnegan, Henderson, Farabow, Garrett & Dunner, L.L.P.

[57] ABSTRACT

A method for driving an AC-type Plasma Display Panel (PDP), and more particularly, for improving the brightness and contrast of the panel by reducing the time of scanning while increasing the discharge time of cells. Accordingly, a video signal is designed to change, as needed, the sequential order of two bits, to insert appropriate erasing pulses into vertical electrodes according to the sequential order of the two bits, and to select the erasing time of each cell being connected to horizontal electrodes. Thus, combining any two or a plurality of subfields reduces the time of scanning while increasing the discharging time of the cells.

20 Claims, 8 Drawing Sheets

METHOD FOR DRIVING AC-TYPE PLASMA DISPLAY PANEL (PDP)

BACKGROUND OF THE INVENTION

The present invention relates to a method for driving a Plasma Display Panel (PDP), one of the flat display devices, and more particularly, to improvement of the brightness and contrast of a 2-electrode or 3-electrode AC-type PDP.

As shown in FIG. 1, a conventional 3-electrode surface discharge Plasma Display Panel comprises the following elements: scanning electrodes 3 to which a scanning pulse is applied during an address period, common electrodes 4 to which a sustaining pulse 8 is applied for the sustaining of discharge, and data electrodes 2 to which a data pulse 12 is applied for generating a sustaining discharge between the scanning electrode 3 and the common electrode 4 of a selection line.

A cell 5 is formed at an intersection where a vertical electrode comprising a set of the scanning electrode 3 and the common electrode 4, and a horizontal electrode comprising the data electrode 2 cross. The cells are accumulated, and they form one plasma display panel 1.

In addition, referring to FIG. 5, a conventional timing diagram comprises: a data pulse 12 maintaining regular intervals applied to a data electrode 2 as shown in (e) of FIG. 5; a Z-sustaining pulse 8 applied to a common electrode 4 as shown in (a) of FIG. 5; and, a Y-sustaining pulse 9 applied to a scanning electrode 3 as shown in (b), (c) and (d) of FIG. 5, wherein the scanning pulse 10 between Y-sustaining pulses 9 is applied sequentially from a first horizontal electrode $S_1$ to a horizontal electrode Sm at point m. Moreover, a scanning pulse 10 is applied to the scanning electrode 3, and thereafter an erasing pulse 11 is applied to the scanning electrode 3 at some intervals.

The above-described PDP generates a discharge by a voltage being applied between the vertical and horizontal electrodes of the cell 5 forming a pixel, sustains the discharge by applying a voltage to a horizontal electrode, and regulates the quantity of light generated by changing the length of discharge time within the cell 5.

To show the entire screen, the data pulse 12 for inputting a digital video signal is applied to the data electrode 2 of each cell; the scanning pulse 10 for scanning, the Y-sustaining pulse 9 for sustaining the discharge, and the erasing pulse 11 for terminating the discharge of the cells are applied to the scanning electrode 3 of each cell; and the Z-sustaining pulse 8 for sustaining the discharge is applied to the common electrode 4.

Each pulse indicated above is applied in a matrix form to the horizontal electrode (scanning electrode+common electrode) and the vertical electrode (data electrode) to show the entire screen.

The gradational gray level required to display an image is materialized by setting a difference in the length of discharge time by each cell within the span of time necessary for the showing of the entire image (in the case of NTSC TV, it requires 1/30 seconds). In the case of a flat display device for a MD TV with the capacity of a 1280×1024 resolution, a video digital signal required to show an image maintaining a 256 gray level is 8 bits.

FIG. 2 shows the scanning method of a conventional art comprising eight sub fields out of one field for the materialization of a 256 gray scale with an 8-bit digital video signal. In other words, one field comprises a plurality of subfields, and to show images containing the gradational gray level, each subfield is arranged to have a different time for the emission of light.

In FIG. 2, one field comprises eight subfields, each has a Ts time, with a gray level of $2^n$=256(n=8). In addition, each subfield has a different emitting time for different lights of T, T/2, T/4, T/8, T/16, T/32, T/64, T/128 and T/256. By adjusting the time for the emission of the light through the eight bit combination and by using the integral effect of eyes for the light, the 256 gray scale is materialized.

According to the pulse timing diagram of the conventional art as shown in FIG. 5, the common electrode 4 between Cl-Cm is applied with the Z-sustaining pulse 8, while applying the Y-sustaining pulse 9 of the same cycle to the scanning electrode 3 between S1–Sm ; however, the timing is different from that of the common electrode.

The scanning pulse 10 and the erasing pulse I 1 are also applied to each scanning electrode 3. The data pulse 12 is applied to the data electrode 2 between D1–Dn at the same timing of the scanning pulse being applied to the scanning electrode. For the radiation of the cell 5 where the scanning electrode 3 and the data electrode 2 cross, the data pulse 12 synchronized to the scanning pulse 10 to be applied to the scanning electrode 3 must be provided to the data electrode 2.

Accordingly, the cell 5 starts to discharge, and the discharge can be sustained by the Z-sustaining pulse 8 and the Y-sustaining pulse 9 being provided to the common electrode 4 and scanning electrode 3. The discharge is terminated by the erasing pulse 11.

For displaying the entire image as it was viewed above, the gray level and contrast of the PDP should be materialized by setting a different length of discharge time of each cell 5 within a fixed time. At this time, the brightness of the image is decided by the gray level shown at the time of driving each cell 5 for the longest span of time. To increase the brightness of the image, the driving circuit of the cell 5 should be so designed as to sustain the maximum length of time for the discharging of the cell 5 within the span of a given time to form a screen.

According to a conventional subfield method, it has to collect digital video signals separately from Most Significant Bit (MSB) to Least Significant Bit (LSB), then form the subfields by assigning the MSB to the discharge time T, and by allocating each bit to the discharge time T/2, T/4, . . ., T/128, respectively, in the order of bits close to the MSB, thus forming the 256 gray scale by using the integral effect of eyes toward the light being emitted from each subfield.

Since the conventional PDP has to be driven by a matrix method, there is a restrictive problem that the data pulses of one or more horizontal electrodes at a time cannot be applied to a given vertical electrode. Because of this reason, the horizontal electrodes have to be driven at different times from each other. Therefore, to form each subfield, time is needed to scan all horizontal electrodes, and the time required for the scanning is increased as the number of the horizontal electrodes increases.

Since the horizontal electrodes are required to be driven at different times from each other, the time being used for the discharging of each cell 5 is reduced as the time of scanning is extended, and it causes the dropping of the brightness and contrast of the PDP.

FIG. 3 shows the scanning of each horizontal electrode toward a time axis according to the subfield method of the conventional art. The subfield can start the scanning of other subfields after terminating the scanning of all horizontal electrodes of a subfield from the restrictive point of the matrix method. As shown in FIG. 4, if the subfield method of the conventional art connects two subfields to reduce the time $T_B$ which emit no light to improve the efficiency of light emission, it requires applying the scanning pulse 10 to a plurality of horizontal electrodes simultaneously at the point, such as a or b, at the same time axis to drive the data pulse 12 being applied to a vertical electrode; however, there is a problem that it is impossible because of a characteristic of the matrix driving method.

SUMMARY OF THE INVENTION

The objects of the present invention are to overcome problems and disadvantages of the conventional method. One object of the present invention is to make it possible to link any two or a plurality of subfields by changing the order of two bits of a video signal relative to each other as needed, inserting an erasing pulse adequately to a vertical electrode according to the changed order, and selecting the erasing time of each cell being connected to a horizontal electrode. Another object of the present invention is to improve the brightness and contrast of the PDP by reducing the time for scanning and increasing the discharge time of the cell.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

For the attainment of the purposes described above, according to the present invention, a method for driving a surface discharge PDP, as embodied and broadly defined herein, comprises placing a plurality of common, scanning and data electrodes between first and second substrates. The common and scanning electrodes are arranged in parallel with each other. The data electrode is arranged orthogonal to the common and scanning electrodes. Cells are formed at intersections where the common and scanning electrodes cross the data electrode. Each cell is discharged when the scanning and data pulses are simultaneously applied. A screen is divided into a plurality of upper and lower bit subfield, and each subfield is scanned without a recess for discharging by combining at least two subfields. Discharge times are set to improve the brightness and contrast of the panel.

It is to be understood that both the foregoing general description and the following detailed description are exemplary and explanatory only and are not restrictive of the invention, as claimed.

The accompanying drawings, which are incorporated in and constitute a part of this specification, illustrate one embodiment of the invention and together with the description, serve to explain the principles of the invention.

DETAILED DESCRIPTION OF THE INVENTION

Reference will now be made in detail to the present preferred embodiments of the invention, examples of which are illustrated in the accompanying drawings. Wherever possible, the same reference numbers will be used throughout the drawings to refer to the same or like parts.

Figure 1:
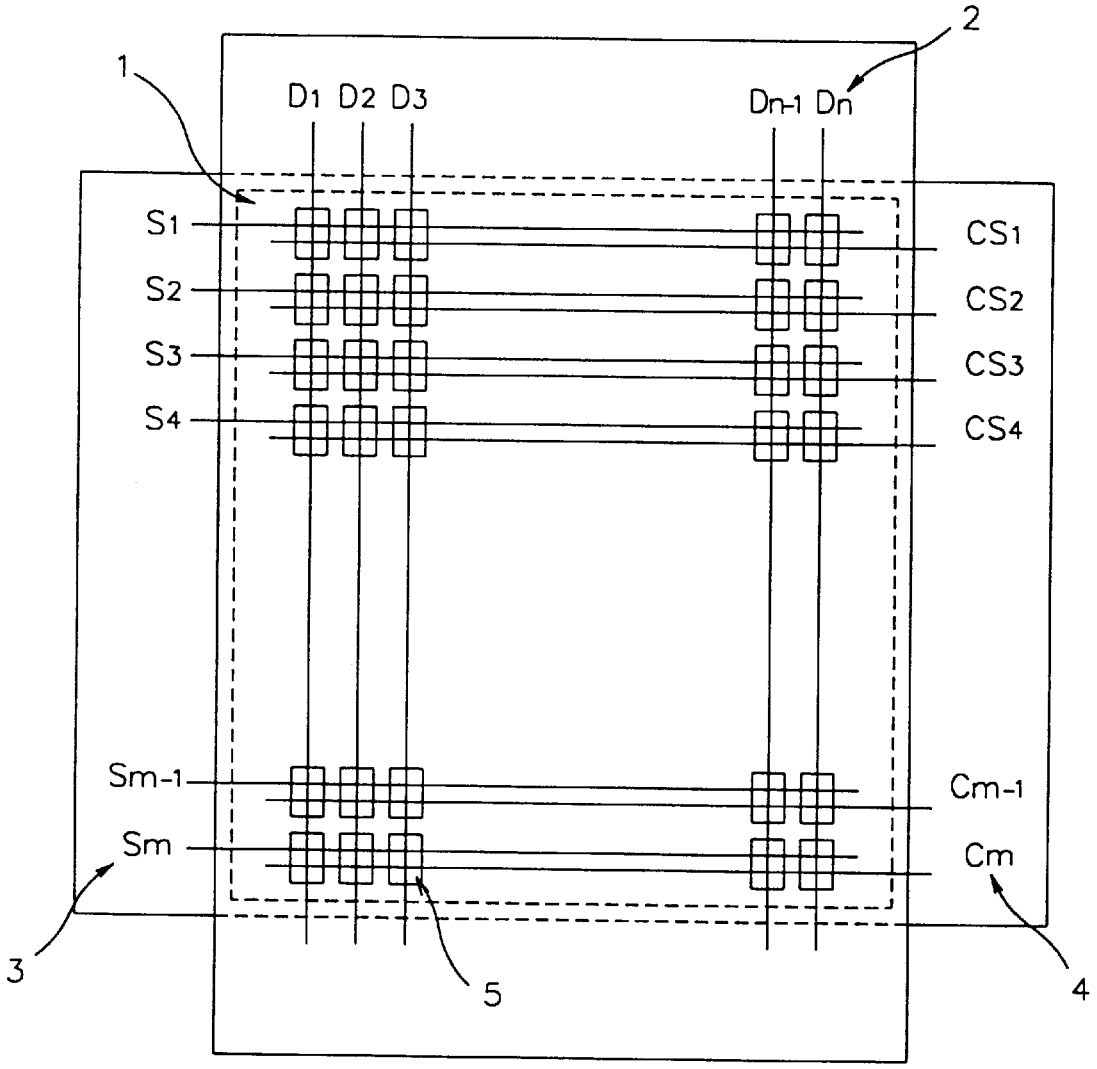
Fig.1 Prior Art
FIG. 1 illustrates a schematic diagram of the electrodes of a conventional PDP.
Figure 2:
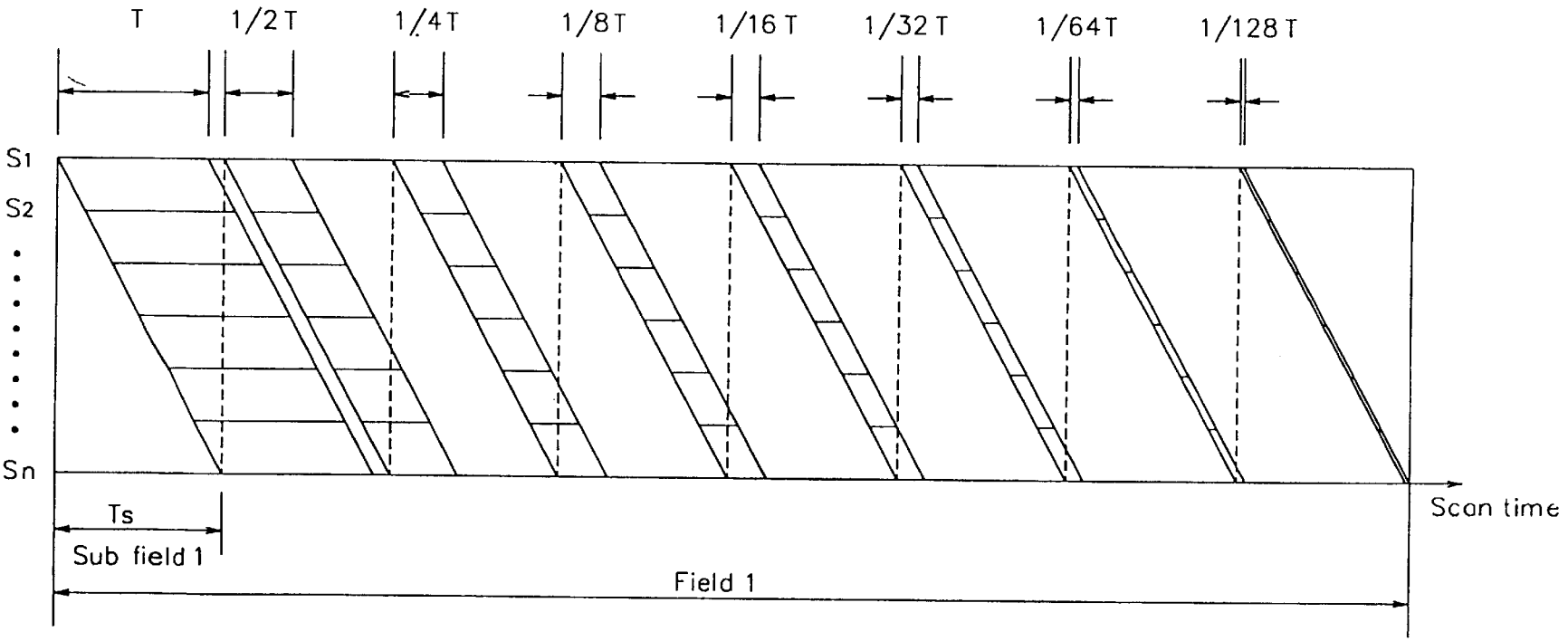
Fig.2 Prior Art
FIG. 2 illustrates the conventional scanning method of the subfields at 256 gray level.
Figure 3:
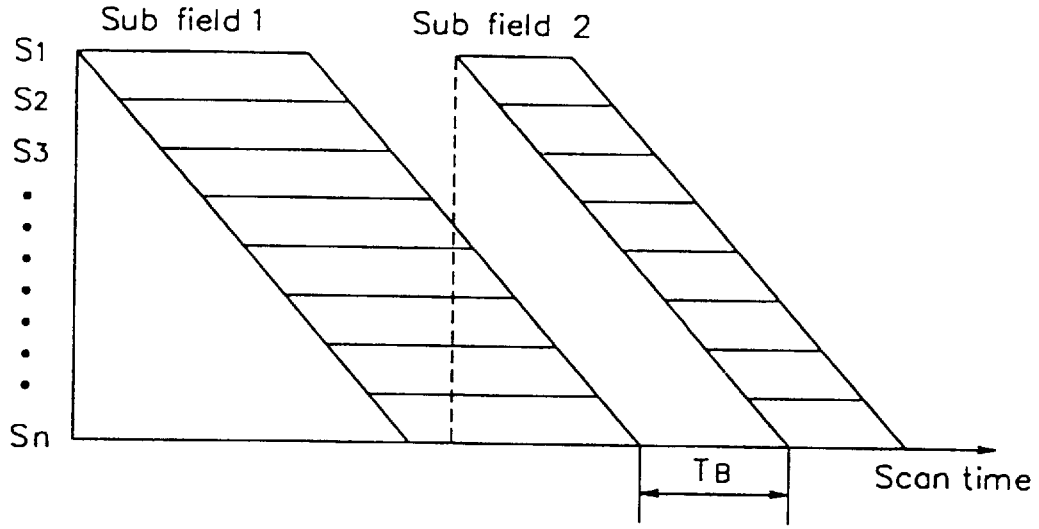
Fig. 3 Prior Art
FIG. 3 illustrates the scanning method of the subfields according to a conventional art.
Figure 6:
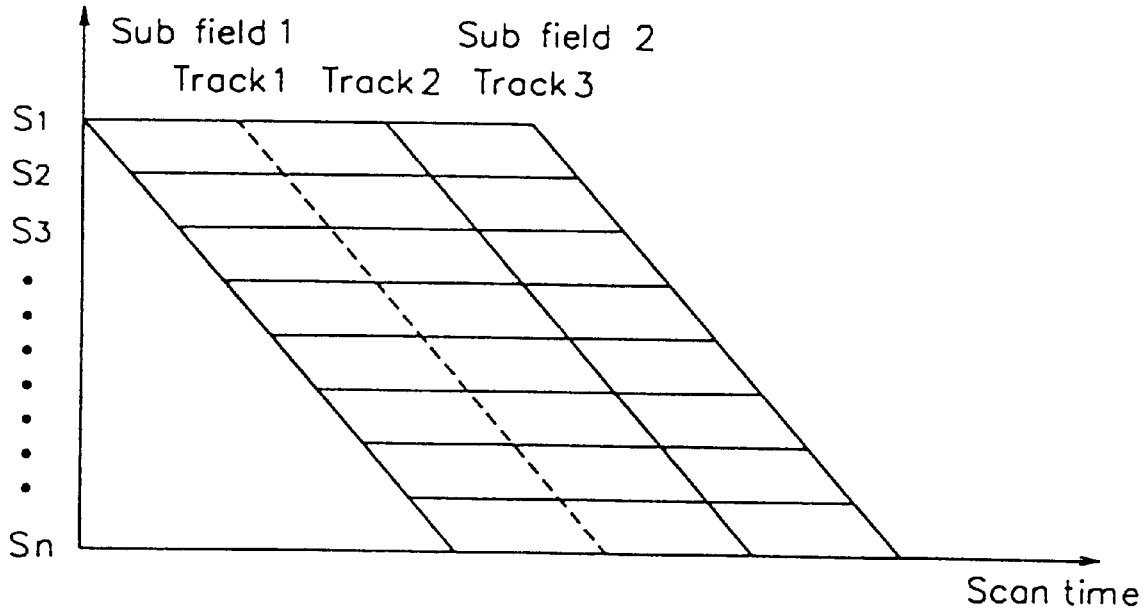
FIG. 6 illustrates the subfield scanning method according to an embodiment of the present invention.
Figure 8:
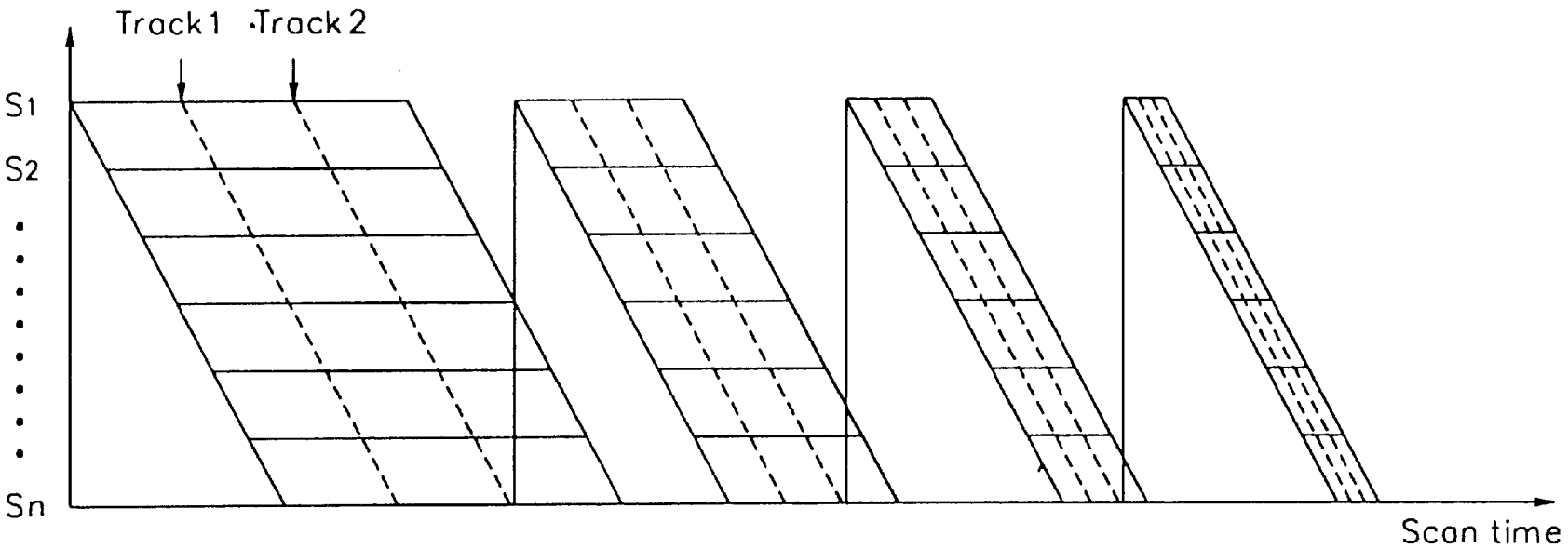
FIG. 8 illustrates an example of the embodiment of the present invention indicating the linking from MSB in sequential order.

FIG. 6 shows a subfield scanning method of the present invention which is formed by linking an adjacent subfield 2 and a subfield 1 of the MSB shown in FIG. 2, which indicates the scanning method of the conventional art. A scanning method of a subfield formed by sequentially linking adjacent bits from MSB to LSB is as shown in FIG. 8.

Figure 7:
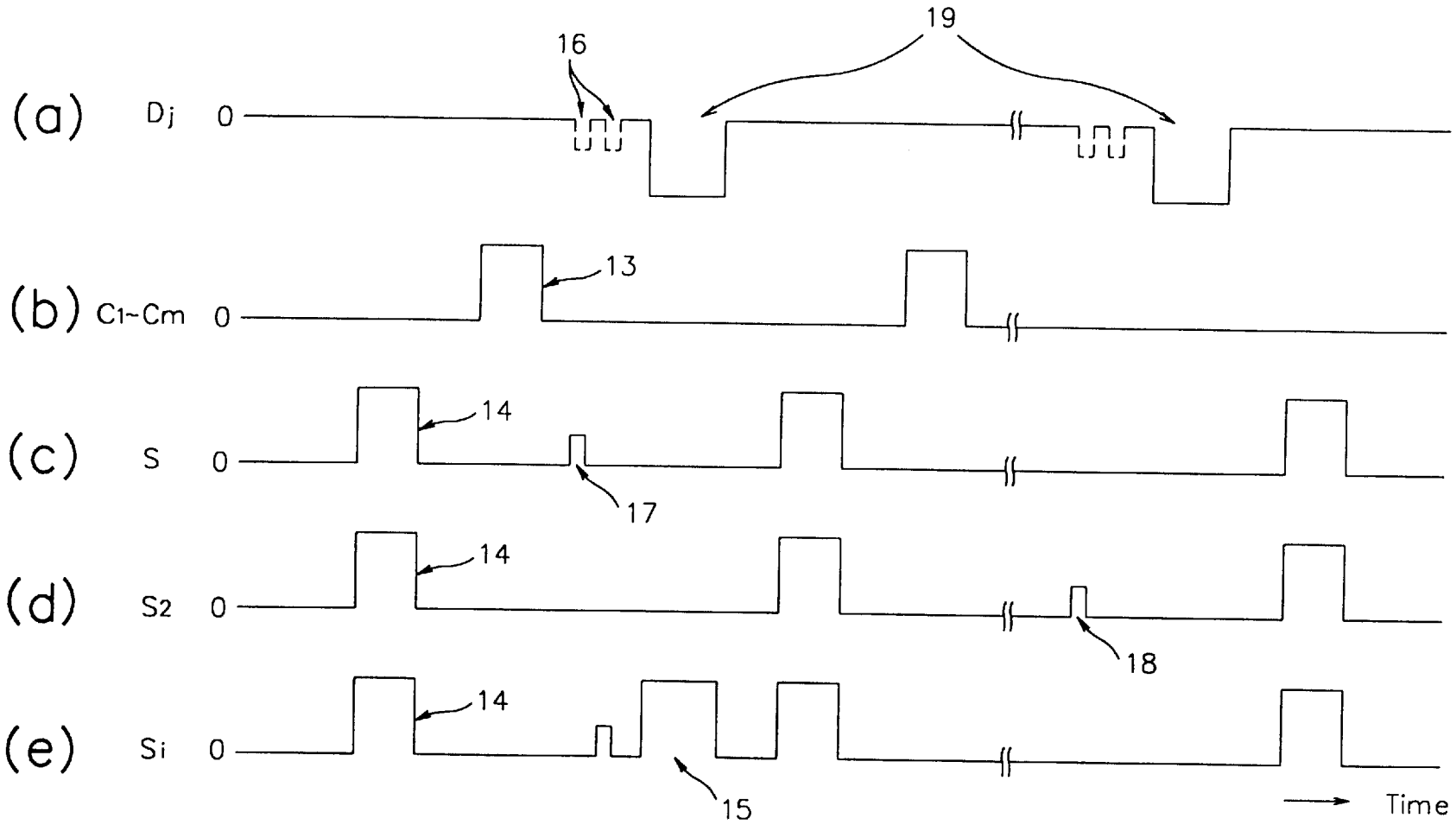
FIG. 7 illustrates a pulse timing diagram for subfield scanning method according to the embodiment of the present invention.

A pulse timing diagram of the present invention is shown in FIG. 7. In this pulse timing diagram, a data electrode is applied with a data pulse 19 maintaining regular intervals and with a plurality of erasing pulses 16 formed between the data pulses. A common electrode 4 is applied with a Z-sustaining pulse 13 also maintaining regular intervals. A scanning electrode 3 is applied with a Y-sustaining pulse 14 and a scanning pulse 15, both maintaining a regular periodic cycle. As it is shown in FIG. 6, when two subfields are linked together, erasing pulses 17 and 18 are applied to scanning electrodes S1 and S2, respectively, to activate erasing on Track 1 and Track 2.

The following describes the operational motion of the present invention. According to the driving method of the conventional art, upon termination of the driving of one subfield, an erasing pulse is sequentially applied to a horizontal electrode, thus the discharging of all cells 5 is terminated. However, according to the method of the present invention, the order of two bits is changed relative to each other as needed by a video signal, and according to this order, an appropriate erasing pulse 16 is inserted into a vertical electrode to select the erasing time of each cell 5 connected to the horizontal electrode.

In FIG. 6, the track 2 indicates the driving time of an erasing pulse of the upper bits when driving the lower bits after the sequential driving of the upper bits first. The track I indicates the driving time of an erasing pulse of the lower bits when driving the upper bits after the driving of the lower bits first.

A digital video signal which is input as shown in FIG. 6 sustainedly maintains its condition without requiring an erasing pulse when the upper bits of the subfield I and the lower bits of the subfield 2 are required to be turned off. When the upper bits are required to be turned on and the lower bits are required to be turned off, the track 2 applies the erasing pulse 18.

However, when the upper bits of the subfield 1 are required to be turned off and the lower bits of the subfield 2 are required to be turned on, a recording must be made by the track 2. According to the conventional art as shown in the FIG. 4, because of the combination of two adjacent subfields, two different scanning electrodes 3 are scanned at points "a" and "b" at the same time, thus the two different data are unable to be recorded at their respective horizontal electrodes.

For the solving of the problem of the conventional art above deriving from the combination of the different subfields, the present invention performs as follows: When the upper bits should be turned off and the lower bits should be turned on, the order of the upper bits and lower bits is changed so as to execute the lower bits first to apply an erasing pulse 17 at track 1.

According to the example of the scanning method of the present invention, the upper bits of a subfield 1 are designated as "1", and the lower bits of a subfield 2 are designated as "2". Based on the above designations, when bit 1 and bit 2 are turned on, it is called "11". When bit 1 is turned on and bit 2 is turned off, it is called "10". When bit 1 is turned off and bit 2 is turned on, it is called "01". When bit 1 and bit 2 are all turned off, it is called "00". Based on the above assumption, the application points of erasing pulses are shown in Table 1 as follows:

TABLE 1

| condition of bit | 00 | 01 | 10 | 11 |
|---|---|---|---|---|
| application points of erasing pulses | X | Track 1 | Track 2 | Track 3 |

Figure 4:
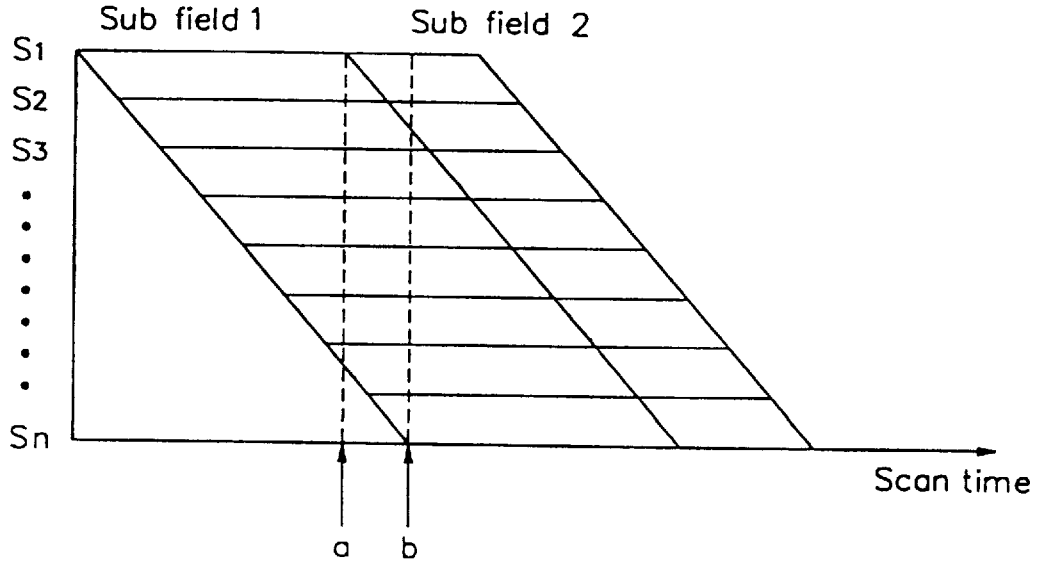
Fig. 4 Prior Art
FIG. 4 illustrates the linking of two subfields under the subfield scanning method according to a conventional art.
Figure 5:
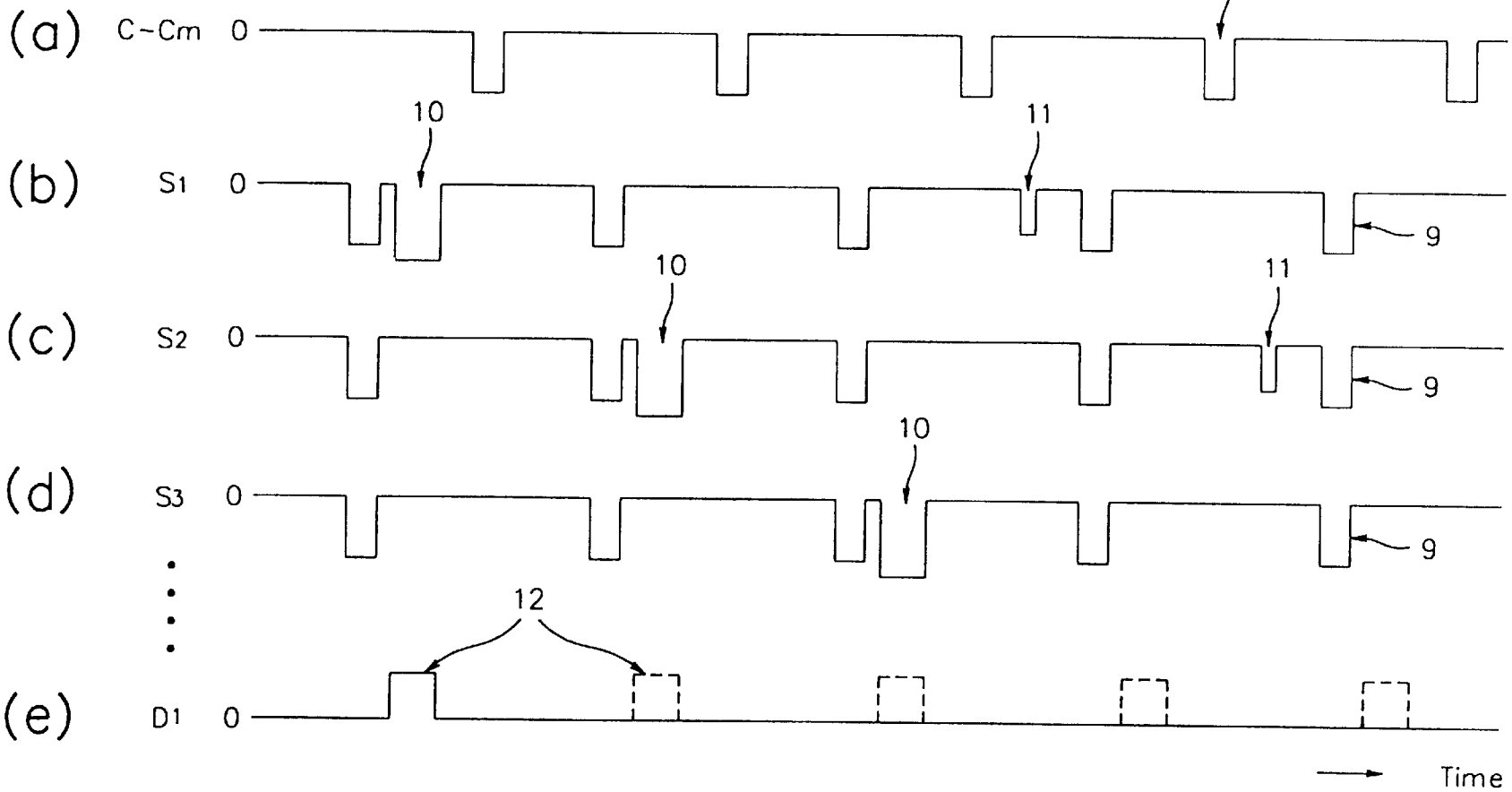
Fig. 5 Prior Art
FIG. 5 illustrates a pulse timing diagram for driving signals according to a conventional art.

FIG. 7 shows a timing diagram of pulses to be used by the present invention. For the discharging of the cells 5 at intersections where a data electrode "Dj" and a scanning electrode "Si" cross, the time of applying the data pulse 19 to the vertical electrode, as shown in FIG. 4, should coincide with the time of applying the scanning pulse 15 to the horizontal electrode.

The termination of discharging the cell 5, in other words, the termination of discharging by the erasing pulse, is carried out by coinciding the time of applying the erasing pulse 16 of the vertical electrode with the time of applying the erasing pulses 17 and 18 of the horizontal electrode.

FIG. 6 indicates cell S1-Dj erased at track 1, and cell S2-Dj is erased at track 2.

FIG. 7(*e*) shows the recording of the cell Si-Dj within the same sustaining cycle of erasing the cell S1-Dj.

Figure 9:
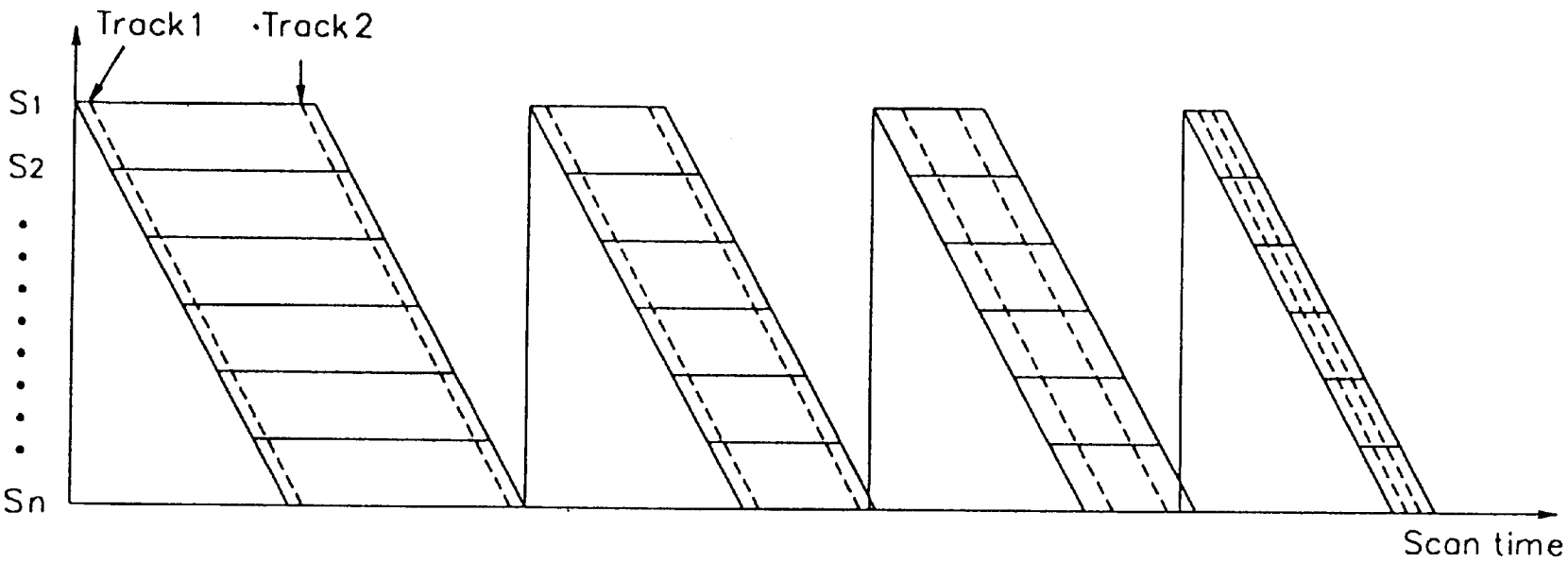
FIG. 9 illustrates another example of the embodiment of the present invention indicating the mutual support binding of upper and lower bits.

FIGS. 8 and 9 show other embodiments of the present invention. FIG. 8 shows an example of a scanning method which has improved the radiating efficiency of a panel by sequentially combining the adjacent subfields from MSB to LSB. FIG. 9 shows an embodiment comprising mutually combining subfields by MSB and LSB, respectively.

In addition, the present invention improves the radiating effect of a panel not only of the combination of two subfields, but also of the combination of three or more subfields. In the case of combining three or more subfields, it has only to designate the point of time of applying an erasing pulse at the pulse timing diagram in FIG. 7.

As indicated above, the present invention can designate the points of applying the erasing pulses from a two-bit combination of a digital input signal according to the condition of the bits. As a result, two subfields can be scanned simultaneously, thus reduces the time of scanning required by the conventional art by half. In addition, by reducing the time of scanning, the discharge time by the PDP cells can also be extended, and thereby an improvement of the brightness and contrast of the entire screen can be obtained.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed:

1. A method of driving a surface discharge Plasma Display Panel, comprising:

placing a plurality of common electrodes, scanning electrodes and data electrodes between a first substrate and a second substrate, the common electrodes and the scanning electrodes being arranged in parallel with each other, the data electrodes being arranged orthogonal to the common electrodes and the scanning electrodes;

forming a cell at an intersection where the common and scanning electrodes cross the data electrode, each cell being discharged when scanning and data pulses are applied at the same time; and dividing a screen into a plurality of upper bits subfields and lower bits subfields, setting discharge times of the subfields different from each other, and scanning each subfield without a recess for discharging by combining at least two subfields and determining a time to apply an erasing pulse to improve brightness and contrast of the panel.

2. The method as in claim 1, further comprising:

determining, from a logic condition of upper bits and lower bits of the combined at least two subfields, a time to apply an erasing pulse in order to drive the combined at least two subfields at the same time; and applying the erasing pulse at said determined time.

3. The method of claim 1, further comprising:

applying an erasing pulse, when the upper bits of the combined at least two subfields are "off" and lower bits of the combined at least two subfields are "on" and after an elapsed time when the lower bits subfield is to be kept turned on.

4. The method as in claim 1, further comprising:

changing the scanning order of the upper bits subfield and the lower bits subfield when the logic condition of the combined at least two subfields indicates that the upper bits are "off" and the lower bits are "on".

5. The method of claim 1, further comprising: applying an erasing pulse, when the upper bits of the combined at least two subfields are "on" and the lower bits of the combined at least two subfields are "off" and after an elapsed time when the upper bits subfield is to be kept turned on.

6. The method of claim 1, further comprising:

applying an erasing pulse, when both said upper and lower bits of the combined at least two subfields are "on" and after an elapsed total time when both of the two combined at least two subfields are to be kept turned on.

7. A method of driving a surface discharge plasma display panel having a two dimensional array of cells, each cell having a data electrode, a common electrode, and a scanning electrode passing therethrough, wherein a cell discharge is initiated by applying substantially simultaneously a data pulse and a scanning pulse to the cell, wherein the cell discharge is terminated by applying at least one erasing pulse to the cell, and wherein the time between the initiation of a cell discharge and the termination of a cell discharge is a cell discharge time, said method comprising:

receiving a signal to display an image on the plasma display panel, the signal comprising a luminosity value for each cell, wherein each luminosity value is a binary number controlling the total discharge time of a cell during the display of the image, wherein a luminosity value of a cell comprises a plurality of bits, wherein each bit represents a subfield, and wherein a value of each bit represents an on or off discharge state of the cell during the subfield corresponding to the bit;

converting the signal into a discharge initiation-termination pulse pattern, wherein the conversion includes linking the plurality of subfields together to form combination subfields, wherein the combination subfields comprise at least two subfields linked together, and wherein a portion of the discharge initiation-termination pulse pattern corresponding to a single combination subfield has at most a single discharge initiation and a single discharge termination; and applying the pulse pattern to the cells of the plasma display panel.

8. The method of claim 7, wherein a discharge initiation comprises a data pulse applied to a data electrode and a scanning pulse applied to a scanning electrode.

9. The method of claim 7, wherein a discharge termination comprises an erasing pulse applied to a data electrode substantially simultaneously with an erasing pulse applied to a scanning electrode.

10. The method of claim 7, wherein the step of creating combination subfields comprises separating the plurality of subfields into groups of two subfields, wherein each combination subfield includes an upper subfield corresponding to an upper bit and a lower subfield corresponding to a lower bit.

11. The method of claim 10, wherein if the upper bit and lower bit of a combination subfield are on, a time between the discharge initiation and the discharge termination of the combination subfield is equal to the combined discharge times of the upper bit and the lower bit.

12. The method of claim 10, wherein if only one of the upper bit and lower bit of a combination subfield is on, a time between the discharge initiation and the discharge termination of the combination subfield is equal to the discharge time of the on bit.

13. The method of claim 10, wherein if the upper bit and lower bit of a combination subfield are off no discharge occurs for that subfield combination.

14. A method of converting a signal into an image on a surface discharge plasma display panel having a two dimensional array of cells, the signal comprises a luminosity value for each cell of the surface discharge plasma display panel, said method comprising:

translating the signal into a discharge initiation-termination pulse pattern, wherein for each cell the translation comprises receiving the luminosity value for the cell, wherein the luminosity value comprises a plurality of bits, wherein each bit corresponds to a subfield, wherein each bit is either in an on or off state, and wherein a bit in an on state corresponds to a discharge time, creating combination subfields by separating the plurality of subfields into groups of at least two subfields, scheduling at most one discharge initiation and one discharge termination for each combination subfield; and applying pulses corresponding to the discharge initiation-termination pulse pattern to the two dimensional array of cells.

15. The method of claim 14, wherein a discharge initiation comprises a data pulse applied to a data electrode and a scanning pulse applied to a scanning electrode.

16. The method of claim 14, wherein a discharge termination comprises an erasing pulse applied to a data electrode substantially simultaneously with an erasing pulse applied to a scanning electrode.

17. The method of claim 14, wherein the step of creating combination subfields comprises separating the plurality of subfields into groups of two subfields, wherein each combination subfield includes an upper subfield corresponding to an upper bit and a lower subfield corresponding to a lower bit.

18. The method of claim 17, wherein if the upper bit and lower bit of a combination subfield are on, a time between the discharge initiation and the discharge termination of the combination subfield is equal to the combined discharge times of the upper bit and the lower bit.

19. The method of claim 17, wherein if only one of the upper bit and lower bit of a combination subfield is on, a time between the discharge initiation and the discharge termination of the combination subfield is equal to the discharge time of the on bit.

20. The method of claim 17, wherein if the upper bit and lower bit of a combination subfield are off no discharge occurs for that subfield combination.

* * * * *